US007798944B2

(12) United States Patent
Suber, III et al.

(10) Patent No.: US 7,798,944 B2
(45) Date of Patent: Sep. 21, 2010

(54) LIQUID WEIGHT SYSTEM FOR BENCH PRESS AND STATIONS OF HOME GYM

(75) Inventors: Edward H. Suber, III, 2400 Romig Rd., Suite 135, Akron, OH (US) 44322; Carey Layton, Akron, OH (US)

(73) Assignee: Edward H. Suber, III, Akron, OH (US)

( * ) Notice: Subject to any disclaimer, the term of this patent is extended or adjusted under 35 U.S.C. 154(b) by 37 days.

(21) Appl. No.: 11/957,591

(22) Filed: Dec. 17, 2007

(65) Prior Publication Data

US 2009/0156373 A1 Jun. 18, 2009

(51) Int. Cl.
*A63B 21/078* (2006.01)

(52) U.S. Cl. ..... 482/104; 482/111; 482/142

(58) Field of Classification Search ..... 482/104, 482/111–112, 142, 908
See application file for complete search history.

(56) References Cited

U.S. PATENT DOCUMENTS 4,050,310 A * 9/1977 Keiser ..... 482/2
4,076,236 A * 2/1978 Ionel ..... 482/108
4,319,747 A * 3/1982 Rogers ..... 482/145
4,531,727 A * 7/1985 Pitre ..... 482/101
4,598,908 A * 7/1986 Morgan ..... 482/138
4,854,576 A * 8/1989 McWain ..... 482/106
4,905,992 A * 3/1990 McWain ..... 482/106
4,997,184 A * 3/1991 Sherman ..... 482/108
5,300,001 A * 4/1994 Sealy ..... 482/108
5,393,285 A * 2/1995 Fischer et al. ..... 482/108
5,823,921 A * 10/1998 Dawson ..... 482/104
5,967,952 A * 10/1999 Bronstein et al. ..... 482/111
5,997,442 A * 12/1999 Cordes ..... 482/52
6,350,220 B1 * 2/2002 Milburn et al. ..... 482/98
6,447,431 B1 * 9/2002 Milburn et al. ..... 482/98
6,758,795 B2 * 7/2004 Barber ..... 482/106
6,994,659 B2 * 2/2006 Kras ..... 482/92
7,207,930 B2 * 4/2007 Bonutti ..... 482/111

* cited by examiner

*Primary Examiner*—Fenn C Mathew
*Assistant Examiner*—Andrew M Tecco
(74) *Attorney, Agent, or Firm*—Edward H. Suber, III; Carey Suber

(57) ABSTRACT

A liquid weight system for a bench press and for stations of a home gym comprises barbells and having hollow portions and expandable disc-bladders which are weight adjustable by means of a utilization of varying levels of liquid supplied from a liquid tank system. The instant abstract is neither intended to define the invention disclosed in this specification nor intended to limit the scope of the invention in any way.

5 Claims, 3 Drawing Sheets

LIQUID WEIGHT SYSTEM FOR BENCH PRESS AND STATIONS OF HOME GYM

RELATED APPLICATIONS

None.

BACKGROUND OF THE INVENTION

1. Field of the Invention

The present invention relates generally to a barbell for a bench press and, more particularly, to a safety cable secured barbell that comprises both a hollow portion and expandable disc-bladders which are weight adjustable by means of a utilization of varying levels of liquid supplied from a liquid tank system.

2. Description of the Related Art

The bench press is a form of weightlifting which primarily focuses on the development of the pectoral or chest muscles. A lifter lies on his/her back on a bench while pushing up and lowering down a weighted bar directly above the chest While the exercise is primarily intended for the development of the chest or pectoral muscles, it also helps develop the anterior deltoids, serratus anterior, coracobrachialis, as well as the triceps.

A barbell bench press starting position is to be lying on a bench with the shoulder blades pinched together to avoid recruiting the anterior deltoid during lifting. Feet are kept flat on the ground or at the end of the bench, with the buttocks always in contact with the bench. The weight is gripped with hands equidistant from the center of the bar, with the elbows bent to 90 degrees at the elbows beneath the wrists. Hand positions can vary in width grips to shift stress between pectorals and triceps. One of the most distinct advantages of free-bar exercise is the control and the balance it requires from lifters. Finer muscles are important to balancing; these muscles are provided with a proper workout when a supinely positioned person fully extends or retracts his arms to lift and to depress a weighted bar. In this manner, both of the weight-discs comprised at the distal ends of a barbell must be balanced such that the weighted bar does not collapse.

There is a form to the bench press which reduces the change of injury and maximally challenges the muscles of the chest. The present invention provides a means to better tone the finer muscles that are required to balance free-bars. These are major problems associated with lifting free weights on the bench press.

The present invention is an improved bench press that comprises a weight bar having a hollow barbell portion that removably contains desired levels of liquid. It is anticipated that liquid shifts as the lifter slightly tilts the weight bar from side-to-side. Mandatory and slight adjustments must be made in response to the shifting liquid levels to prevent the bar's collapse; the lifter is forced to concentrate on those finer muscles.

The present invention further has a safety cable to avoid the bar falling on and trapping the lifter. This eliminates the need for a 'spotting partner', and increases the safety of the movement at heavier weights, or with solo lifter. Further, the present invention is different from conventional Smith machines that constrain the motion of the barbell to a single plane, thereby not developing the stabilization skills. Without being caged in by steel runners, the users ability to force the bar into the proper form is made possible such that lifting ability translates into free weight lifting abilities A search of the prior art reveals no patents that read directly on the claims of the present invention; however, the following patents are considered pertinent:

A Weightlifting Device and Method of U.S. Pat. No. 6,447,431 to Milburn et al. teaches a device that retrofits a conventional weight machine, wherein a proximal charge tank stores water used to fill a load tank that rests on top of a weight stack; an Exercise Apparatus taught in U.S. Pat. No. 5,393,285 to Fischer, Sr. et al. comprises a fluid mass disposed within a chamber of a rigid body, wherein the fluid moves in response to movement to increase the effective mass of the device during exercise; and, A Portable Multi-Purpose Exercise System in U.S. Pat. No. 5,997,442 to Cordes teaches barbells that interconnect to hollow, rigid discs, wherein the discs are fillable with water.

The present invention is distinct from the foregoing because it teaches a hollow barbell that contains liquid which moves about therein. Because the liquid shifts across a length of the barbell, the present invention comprises a safety feature to prevent an injury if the lifter is thrown off balance by a movement of it. This feature comprises dial adjustable safety cables affixed to arms that support the resting dumbbell. A search of the prior art similarly reveals relevant references:

U.S. Pat. No. 4,709,922 to Slade, Jr., et al. teaches a barbell support apparatus comprising an overhead pulley that supports and guides a steel wire support cable, wherein a suspension system provides a means to adjust a height of the barbell; and, U.S. Pat. No. 4,324,398 to Hole teaches a bench press having cables and an adjustable safety locking bar to limit a height to which a barbell may descend.

An improvement to the present safety cable is that separate cables are affixed to respective ends of the barbell and their corresponding arms, such that an imbalance at a first end does not effect control at an opposing end. The present cables are also distinguishable from the foregoing cables because they have channels through which liquid solution travels.

The present invention is a novel and an effective means to tone and to work on finer muscles that are often missed during lifting.

SUMMARY OF THE INVENTION

It is an object of the present invention to provide a liquid weighted bench press. It is an object that the present bench press comprises a hollow barbell portion that is used in the distribution of a liquid. It is an object that a movement of the liquid about a length of the barbell forces a lifter to focus and to tone finer muscles on balancing it. It is an additional object that expandable bladder-discs are comprised at both distal ends of the barbell. It is an object that the expandable bladders are refillable with different levels of liquid to provide the bench press with varying weights and resistance. It is an object that the expandable bladder-discs obviate an adding of or a changing of a plurality of conventional weighted discs on barbells.

It is an object that at least one liquid tank system stores the liquid used to fill the barbell and the expandable bladders. It is an object that the liquid can be delivered both to and from the storage tank and to and from the barbell and bladders, wherein it travels back-and-forth through a cable.

It is an object that safety cables provide a means for a lifter to exercise without a spotting partner. It is an object that adjustable dials are set to limit a height to which the barbell may descend. It is a further object that the safety cables, proximate to each distal end of the barbell, are the means to limit that height. It is an object that the at least two safety cables provide a means to limit the barbell's height at individual ends in a case the lifter only loses balance on a first of those two ends.

It is a final object to provide all of the advantages that the foregoing objects entail.

BRIEF DESCRIPTION OF THE DRAWINGS

The advantages and the features of the present invention are better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
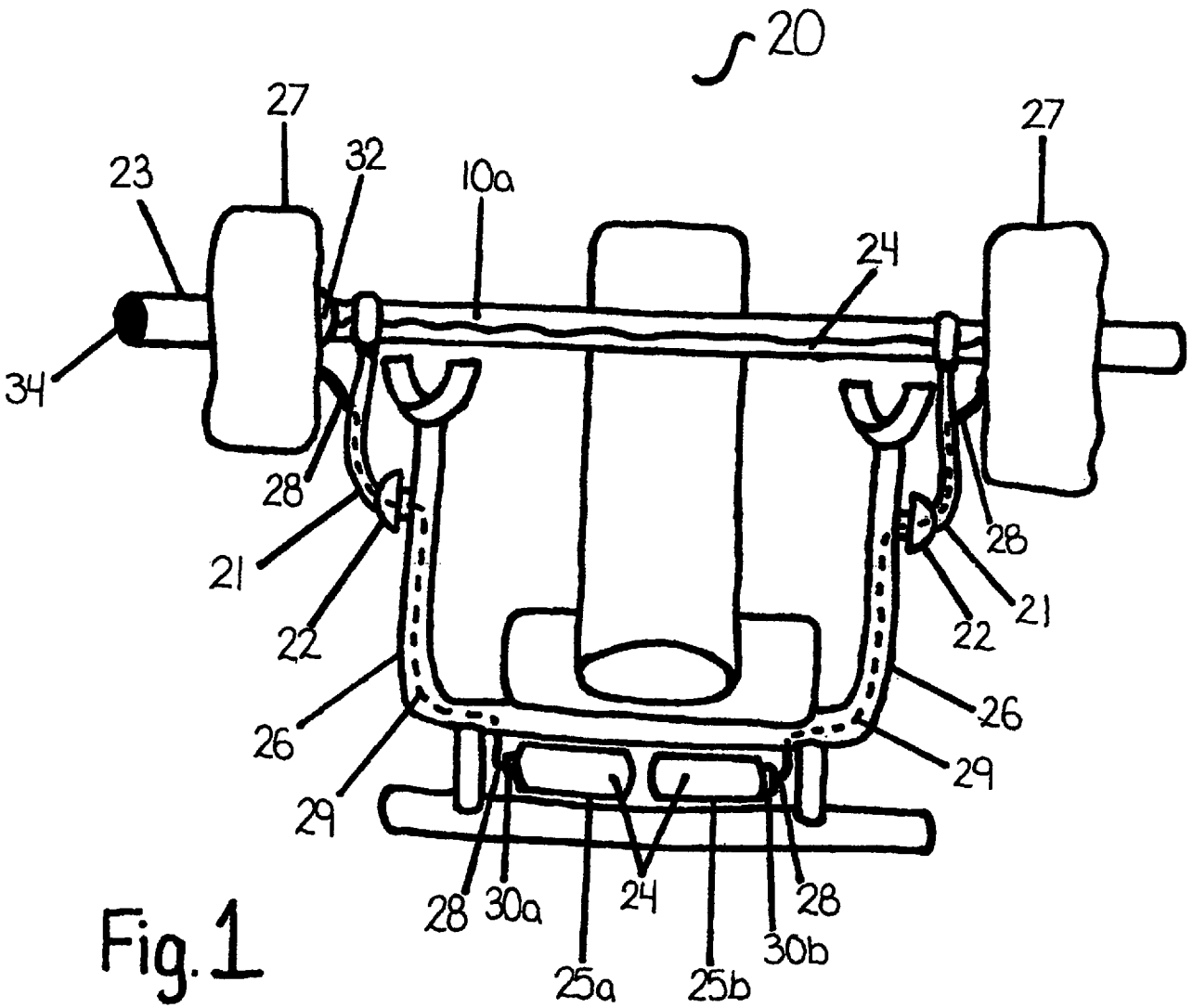
FIG. 1 is a perspective view of a preferred embodiment of a liquid weighted lifting machine.

A perspective view of a liquid weighted bench press system 20 (hereinafter the "bench press") is shown in FIG. 1 according to a preferred embodiment of the present invention. The present invention comprises a barbell 23 having a refillable, hollow center portion 10*a* used for the distribution of solution, but any solution may be utilized to accomplish a same function. Weighted bladder-discs 27 are comprised at the proximate distal ends of the barbell 23. The expandable bladder-discs 27 are similarly capable of being filled with a desired amount of liquid to add weight resistance. A release valve 32 provides a means to free and to limit the liquid or other liquid solution 24 flow into the hollow portion 10*a* of the barbell 23. Valves may alternatively be directly positioned on the barbell 23; their placement is not a limiting factor to the present teachings. A drain plug 34 provides a means for all liquid to be drained from both the barbell 23 and the weighted discs 27 when the bench press is disassembled.

Safety cables 21 prevent the barbell 23 from falling and injuring a lifter who loses a balance of it. The safety cables 21 are connected to at least one liquid tank system 25*a*, 25*b* by means of bench-uprights 26. The bench-uprights 26 are arms having concave hand portions that the barbell 23 rests on when the exercise equipment is not utilized. There may be clearance between the arms and the bench sides, but the arms 26 extend upwards from the bench's left side and right side at its head-end. The arms 26 must reach a height that provides a means for the length of the safety cables 21 to vary. A dial 22 is provided to adjust the safety cables 21. The tanks 25*a*, 25*b* are in fluid communication with the expandable bladder-discs 27 and the barbell 23. The tanks 25*a*, 25*b* store the liquid 24 that travels through channels 28, upwards through a passage 29 formed in an interior of the bench-uprights 26, and fill the bladder-discs 27 and the hollow portion 10*a* (either simultaneously or individually). The weight resistance, i.e., the amount of liquid allowed to enter the individual bladder-discs 27 and the hollow portion 10*a*, is set by means of at least one dial 30*a*, 30*b* on each of the at least one tanks 25*a*, 25*b*. The placement of the tanks 25*a*, 25*b* and the dials 30*a*, 30*b* is not limited to any one defined position.

Figure 2:
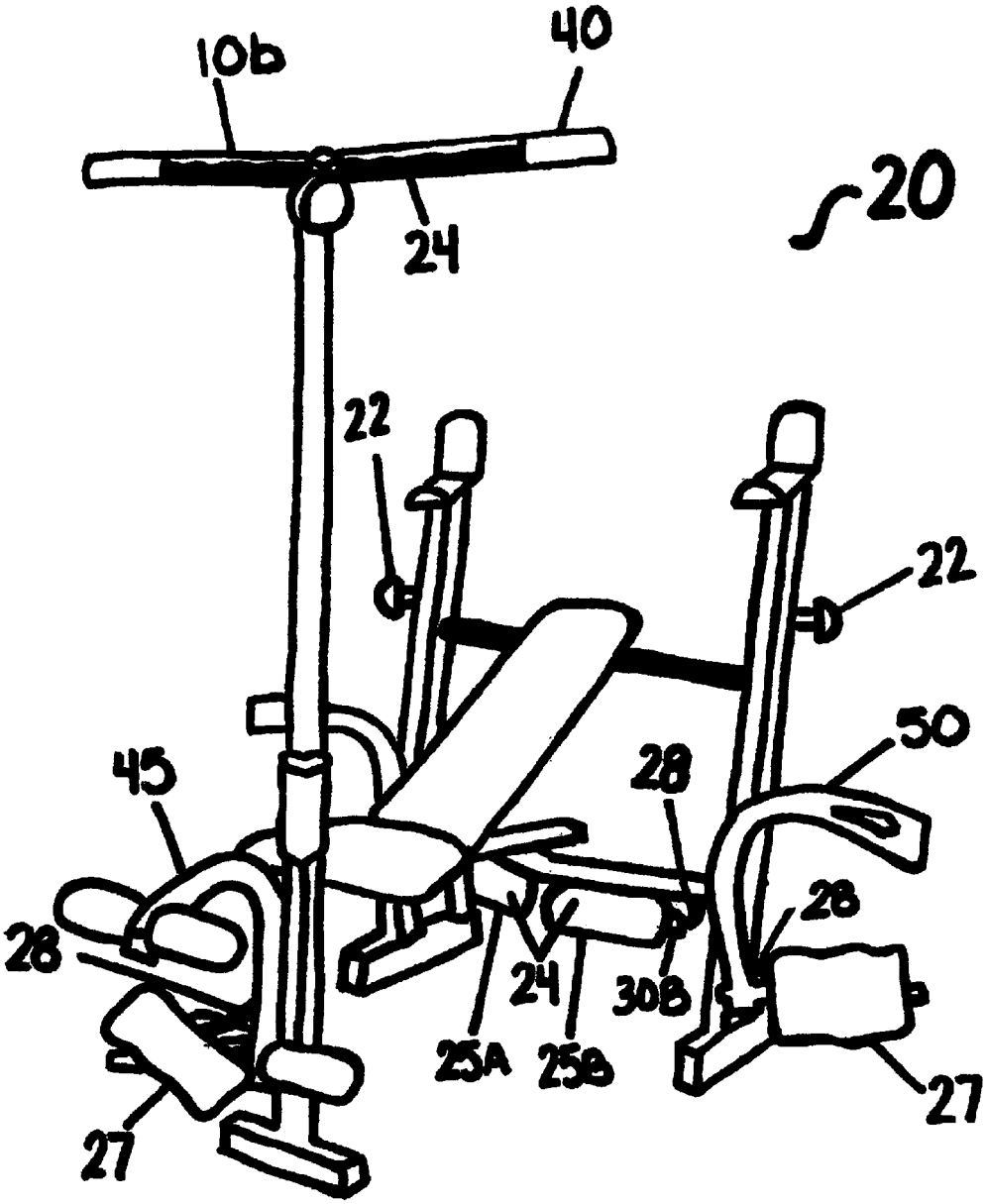
FIG. 2 is an elevational front view of the a liquid weight system shown in accordance with an alternate embodiment.

FIG. 2 shows the liquid weight system shown in an alternate embodiment incorporating a different type of equipment than that of the bench press of FIG. 1 FIG. 2 more specifically shows a home gym 20 that is known in the art to provide a full body workout. While the features and functions of the present invention can be practiced in combination with the elements of the home gym equipment, as an optional feature the present invention can be added on to otherwise existing and conventional other exercise equipment. The home gym 20 comprises a pulley bar 40 having a hollow center portion 10*b*. It is anticipated that the hollow bar 10*b* can vary, depending upon the type of exercise or type of exercise equipment, and could also be detachable for use by itself. The pulley bar shown in the figure is manually filled with a liquid solution, but any means known in the art to adjust the liquid level of the center portion 10*b* may be utilized. Both a leg extension/leg curl attachment 45 and a fly machine attachment 50 comprise expandable bladders 27. A liquid tank system 25*a*, 25*b*, having at least one tank, supplies liquid solution to the bladders 27. The liquid solution travels from the tank 25*a*, 25*b*, through a channel 28 to the appropriate attachment 45, 50 or other attachment such as a bench press or other type of weight machine. The weight resistance is manually set by dials 30*a*, 30*b* on respective tanks 25*a*, 25*b*; however, a computer operated system may alternatively be utilized with the present liquid weight system. A dial adjustment 22 allows for adjustment to the length of the cables 28 to accommodate variation among users.

The foregoing is considered as illustrative only; numerous modifications and changes will readily occur by those skilled in the art. The present teachings are not desired to limit the invention to the exact construction shown and described and, accordingly, all suitable modifications and equivalents that fall within a scope of the invention may be resorted to. For example, the expandable bladder discs 27, the hollow bar portions 10*a* and 10*b* and the liquid tank systems 25*a*, 25*b* may be added to other stations of a home gym, such as a leg press, an abdominal crunch, a chest press, a pulldown bar, etc.

2. Operation of the Preferred Embodiment

Figures 3, 4:
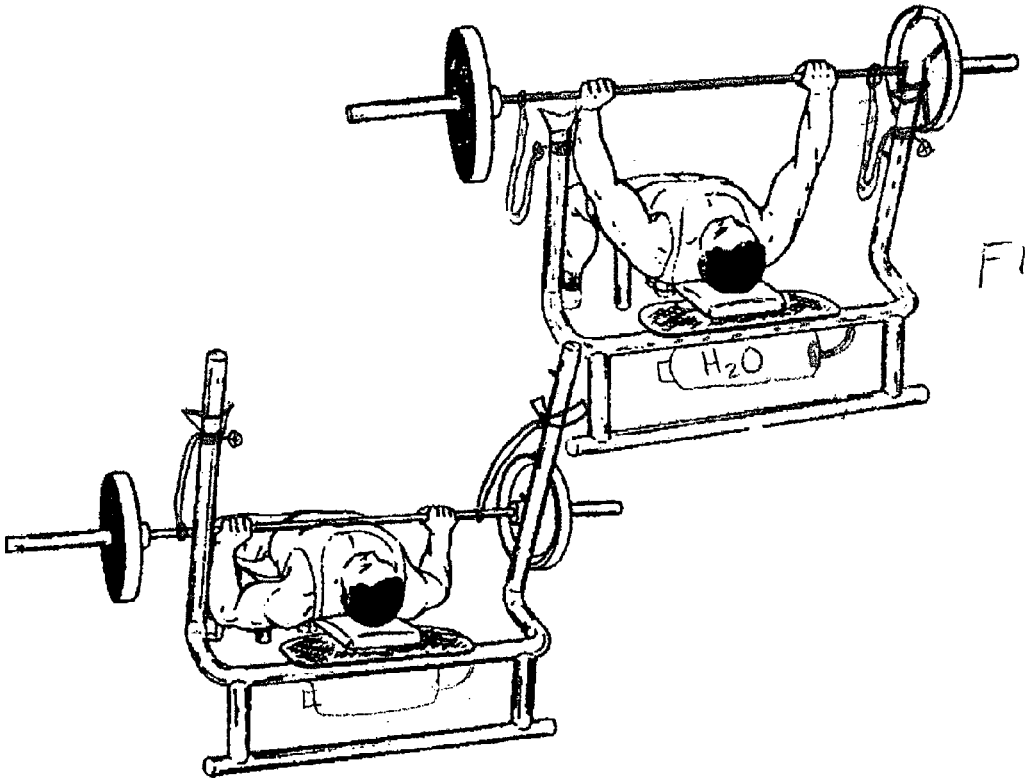
FIG. 3 is an elevational rear view of the liquid weighted lifting machine of FIG. 1, wherein a person's arms are fully extended to lift the barbell above him; and, FIG. 4 is an elevational view of the bench press of FIG. 1, wherein the barbell is fully descended.

An assembly of the liquid weight system is best understood in FIGS. 1 and 2; an operation of the liquid weight system is shown in FIGS. 3 and 4. FIGS. 1 and 2 show a general assembly of the liquid weight system, wherein the cables 28 are either placed through an interior passage of or affixed to an exterior sidewall of the bench uprights 26. It is preferred that they are placed through partially hollow bench uprights 26 during the general assembly of the exercise machine. The channels 28 extend from a proximate top end of the bench uprights 26 and allows the liquid solution 24 to travel to respective valves on the barbell, just inside the bladder-discs 27. The general assembly is completed when the liquid storage tanks 25*a*, 25*b* are installed in an inconspicuous location, s.a., underneath a station where they will not hinder a free movement of exercise, and the safety straps are attached.

FIGS. 3 and 4 more specifically show a person utilizing the liquid weight system on a bench press. The person uses a dial to adjust a length to which the safety cable extends. It is anticipated that the length is adjusted only so far as a difference between the bench-upright and a widest part of the person's chest. The liquid dials are set to adjust the amount of liquid filled in each bladder-disc and the hollow portion.

Valves respond to the dials by allowing only enough liquid to pass through the channels to achieve the specific desired weight. The person lies in a supine position on the bench with his or her feet flat to the ground. That person grips the barbell with his hands equidistant from its center. As he fully extends his arms to lift the barbell above him, as shown in FIG. 3, liquid swishes in the weighted discs and travels a length of the barbell's hollow center portion. This liquid causes the barbell to tilt off balance, thus forcing the person to expend greater muscular effort to retain the barbell in position. The person continues to lift and to lower the barbell in a manner similar to that used for conventional barbells.

If the person should lose control of the barbell (and there is no spotting person), the safety cable stops the barbell from fully descending to the bench. It is therefore anticipated that the person is not at risk of being crushed or pinned under its weight.

To increase the weight resistance, the user adjusts the dial, as opposed to adding more discs. Another advantage of a filling of the hollow center portion of the barbell is that a levelness of the barbell may be tracked, by means of the release valve, during a lifting and a lowering routine. If one arm is weaker than another, for example, because the barbell is not lifted evenly, then the level liquid adjusts to fill more on the weaker side. This adds resistance for the weaker arm; the person strengthens the arms at an equal and a balanced pace.

The foregoing descriptions of specific embodiments of the present invention are presented for the purposes of illustration and description. They are not intended to be exhaustive nor to limit the invention to the precise forms disclosed and, obviously, many modifications and variations are possible in light of the above teaching. The embodiments are chosen and described in order to best explain the principles of the invention and its practical application, to thereby enable others skilled in the art to best utilize the invention and its various embodiments with various modifications as are suited to the particular use contemplated. It is intended that the scope of the invention be defined by the claims appended hereto and to their equivalents. Therefore, the scope of the invention is to be limited only by the following claims.

Having thus described the invention what is claimed as new and desired to be secured by Letters Patent is as follows:

1. An exercise system comprising a liquid weighted bench press system, said liquid weighted bench press system comprising a barbell having a hollow center portion, wherein said hollow center portion is used for the distribution of variable amounts of liquid solution, said weighted bench press system comprising adjustable safety cables affixed to upper portion of both bench uprights, said bench press system wherein a length of safety cables is adjusted by means of a dial, said weighted bench press system wherein a liquid solution travels from liquid tank system to bar by means of a base cable, wherein liquid travels upwards through a passage inside said bench uprights, said base cable is affixed to channels at a top portion of said bench uprights, said channels are affixed to said bar.

2. The exercise system of claim 1, further comprising expandable bladder discs that change size when the amount of liquid is increased filling said bladder discs, bladder discs are located at proximate distal ends of said barbell, said bladder-discs will inflate with liquid taking size equivalent to the amount of liquid it is holding, said bladder discs will have at least one release valve provided as a means to free liquid from both bladder discs and said hollow center portion of said bar, as liquid flows out of said bladder discs the bladder discs will flatten, said bladder discs will be controlled by a valve.

3. The exercise system of claim 1, further comprising at least one-drain plug on said barbell.

4. The exercise system of claim 1, wherein at least one dial provides a means to select a desired weight resistance.

5. The exercise system of claim 1, further comprising a liquid tank system in fluid communication with said barbell, said tank system stores said liquid solution used to increase said weight resistance of said barbell.

* * * * *